United States Patent [19]

Kunst et al.

[11] 4,292,094

[45] Sep. 29, 1981

[54] PROCESS FOR INCREASING THE CORROSION RESISTANCE OF NITRIDED STRUCTURAL PARTS MADE OF IRON MATERIAL

[75] Inventors: Helmut Kunst, Rodenbach; Christian Scondo, Hanau, both of Fed. Rep. of Germany

[73] Assignee: Degussa Aktiengesellschaft, Frankfurt, Fed. Rep. of Germany

[21] Appl. No.: 177,797

[22] Filed: Aug. 13, 1980

[30] Foreign Application Priority Data

Aug. 23, 1979 [DE] Fed. Rep. of Germany ..... 2934113

[51] Int. Cl.[3] ..... C23F 7/04

[52] U.S. Cl. ..... 148/6.11; 148/15.5

[58] Field of Search ..... 148/6.11, 15.5

[56] References Cited

U.S. PATENT DOCUMENTS

| | | | |
|---|---|---|---|
| 2,513,302 | 7/1950 | Feild | 148/6.11 |
| 2,639,244 | 5/1953 | Vordahl et al. | 148/6.11 |
| 4,055,446 | 10/1977 | Kunst et al. | 148/15.5 |

*Primary Examiner*—Ralph S. Kendall

*Attorney, Agent, or Firm*—Cushman, Darby & Cushman

[57] ABSTRACT

To increase the corrosion resistance of nitrided structural parts made of iron materials which are useful for all types of iron and steel there is carried out an oxidation treatment in connection with the nitriding process. The oxidation treatment is carried out for 15 to 50 minutes in an oxidizing salt bath. The salt bath preferably consists of alkali hydroxides with 2 to 20% of alkali nitrates.

3 Claims, No Drawings

PROCESS FOR INCREASING THE CORROSION RESISTANCE OF NITRIDED STRUCTURAL PARTS MADE OF IRON MATERIAL

BACKGROUND OF THE INVENTION

The invention is directed to a process for increasing the corrosion resistance of nitrided structural parts made of iron materials by an oxidation treatment carried out in connection with the nitriding.

By nitriding structural parts made of iron materials there is also increased their resistance to corrosion with the exception of rust and acid resistant steels. This state of affairs has been known for a very long time. The effect occurring is independent of the nitriding process (salt bath, short time gas, powder, plasma nitrided) used. The only exception is the so-called classical gas nitriding in ammonia in which generally the compound zone formed is worked off.

In the industrial use of the nitriding for the purpose of improving the welding properties and increasing the fatigue strength, as it is practised at present, the improvement of the corrosion properties are regarded as welcome side effects. However, there is no known case in which the nitriding is used exclusively for the purpose of increasing the corrosion resistance. Therefore, there are known efficient methods, e.g. chromeplating and the like.

Under the designation "special blues" there is known in the art a combination of nitriding and steam tempering. This process serves exclusively for the improvement of the welding properties of chill casting and consists of a combination of the so-called classical gas nitriding with a steam tempering at relatively high temperature. Furthermore it is also known that this treatment leads to an improved oxidation resistance. The known process, however, is only usable to a very limited extent, namely only for the mentioned group of work materials.

Therefore, it was the problem of the invention to find a process for increasing the corrosion resistance of nitrided structural parts made of iron materials by an oxidation treatment in connection with the nitriding process which is usable for all iron material.

SUMMARY OF THE INVENTION

This problem was solved by the invention by carrying out the oxidation treatment in an oxidizing salt bath for a time of 15 to 50 minutes. Preferably the oxidation treatment is carried out for 25 to 45 minutes.

In a completely surprising manner it has been shown thereby that the corrosion resistance of the structural parts which are nitrided and subsequently oxidized by treatment in an oxidizing salt bath is substantially higher than that of those parts only in the nitrided condition and also exceeds many times that of chromed structural parts.

There is known from German OS No. 2514398 and related Kunst U.S. Pat. No. 4,055,446 an oxidizing salt bath for the subsequent treatment and quenching of bath nitrided structured parts which make possible the elimination of the small portions of cyanide and cyanate entrained from the nitriding salt bath. For this it is necessary to leave the nitrided part as long in this bath until the detoxification reaction has completely occurred. The duration of this reaction is dependent on the temperature and is between about 5 minutes (temperature 200° C.) and several seconds (400° C.). As a rule therefore, the parts are only left in the bath long enough for quenching and subsequently treatment that the parts reach the bath temperature, i.e. a maximum of about 10 minutes. The entire disclosure of the Kunst U.S. patent is hereby incorporation by reference.

It has been completely surprisingly shown that with structural parts that the longer the time in such a bath increases the corrosion resistance considerably.

There have been found satisfactory for the process of the invention salt baths which consist of a mixture of alkali hydroxides, preferably with addition of 2 to 20% of alkali nitrate. Thus the salt bath can comprise, consist essentially of or consist of sodium hydroxide, potassium hydroxide or lithium hydroxide or a mixture of such alkali hydroxides and the nitrate can be sodium nitrate, potassium nitrate or lithium nitrate or a mixture thereof. Usually there is employed a mixture of sodium hydroxide and potassium hydroxide with potassium nitrate and/or sodium nitrate.

The oxidation treatment preferably takes place at a temperature of 250° to 450° C.

The process can comprise, consist essentially of or consist of the stated steps with the stated materials.

Unless otherwise indicated all parts and percentages are by weight.

The following example shows the advantages of the process of the invention.

DETAILED DESCRIPTION OF THE INVENTION

A salt spray test was carried out according to the customary process on samples of the steels C15 and 42CrMo4 the untreated salt bath nitrided and quenched according to the customary process and salt bath nitrided and post treated according to the process of the invention.

There were measured the time in hours until the first occurrence of traces of rust. The results are set forth in the following table.

TABLE

| Type of Steel | C15 | 42CrMo4 |
|---|---|---|
| Untreated | 132h | 176h |
| Salt bath nitrided, quenched in water or oil | 132h | 176h |
| Salt bath nitrided, cooled in a salt bath based on alkali hydroxide and nitrate, duration of treatment 35 minutes, temperature: 350° C. | 236h | 300h |
| Hard chromed | 190–220h | 190–220h |

Similar results were ontained in other corrosion testing processes (condensation water test, sea water test).

The carrying out of the oxidation treatment according to the invention is carried out most simply in the combination between nitriding and oxidation salt bath, since in this case the parts simply can be hung. Suitably the parts remain in the oxidation salt bath between 25 and 45 minutes and then are cooled in water to room temperature.

For the success of the oxidation treatment connected to the nitriding it is unimportant which nitriding process is chosen. The oxidation in the salt bath can also be carried out in connection with the powder, short time gas or glow nitriding. To be sure in such case the process is indeed more cumbersome since a direct placing of the nitriding medium in the oxidizing salt bath is not possible.

The following examples further explain the process of the invention.

EXAMPLE 1

Bent sheet metal parts about 120 mm long and 60 mm wide made of steel type C15 were nitrided at 580° C. for 45 minutes in a salt bath in which the bath composition was 37.6% cyanate and 1.8% cyanide, specifically the bath was composed of 37.6% $CNO^-$ 1.8% $CN^-$, 14.5% $CO_3^{2-}$, 37.2% $K^+$ and 8.9% $Na^+$. Subsequently the sheet metal parts were oxidizingly post treated in a salt bath having the composition 37.4 weight % sodium hydroxide, 52.6 weight % potassium hydroxide and 10.0 weight % sodium nitrate.

EXAMPLE 2

Rods 450 mm long and 18 mm in diameter made of steel type 42CrMo4 were nitrided for 120 minutes at 570° C. in a gaseous mixture having the composition 50% ammonia and 50% endogas.

After withdrawal of the parts from the nitriding oven they were oxidizingly post-treated for 40 minutes at 400° C. in a salt bath having the same composition as in Example 1. Subsequently they were cooled off in water to 30° C.

EXAMPLE 3

Work pieces of cold worked steel were exposed to a glow discharge for 240 minutes under nitrogen at 530° C. Then they were oxidizingly post-treated in a salt bath of the composition set forth in Example 1.

In all the examples corrosion investigation were undertaken, which in all cases compared to the only nitrided composition, gave a substantially higher corrosion resistance.

The entire disclosure of German priority application No. P 2934113.7 is hereby incorporated by reference.

What is claimed is:

1. In a process for the treatment of nitrided structural parts of iron work pieces by an oxidation treatment subsequent to the nitriding process, the improvement comprising increasing the corrosion resistance of the nitrided parts by treating at a temperature of 250° to 450° C. in an oxidizing salt bath consisting of an alkali hydroxide with 2 to 20% of alkali nitrate for 25 to 50 minutes.

2. A process according to claim 1 wherein the oxidizing treatment is carried out for 25 to 45 minutes.

3. A process according to claim 1 wherein the salt bath consists of (a) sodium hydroxide, potassium hydroxide or mixtures thereof and (b) sodium nitrate, potassium nitrate and mixtures thereof.

* * * * *